US008364072B2

(12) United States Patent
Bober et al.

(10) Patent No.: US 8,364,072 B2
(45) Date of Patent: Jan. 29, 2013

(54) RECONFIGURABLE SHEET TRANSPORT MODULE

(75) Inventors: Henry T Bober, Fairport, NY (US); James J Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 850 days.

(21) Appl. No.: 12/211,853

(22) Filed: Sep. 17, 2008

(65) Prior Publication Data

US 2010/0067966 A1 Mar. 18, 2010

(51) Int. Cl.
*G03G 15/00* (2006.01)

(52) U.S. Cl. ..... 399/401; 399/388; 399/397; 399/407

(58) Field of Classification Search ..... 399/397, 399/388, 401, 391; 271/302
See application file for complete search history.

(56) References Cited

U.S. PATENT DOCUMENTS

| | | | | |
|---|---|---|---|---|
| 4,873,554 | A | 10/1989 | Greco, Jr. | |
| 5,144,369 | A | 9/1992 | Benedict et al. | |
| 5,850,581 | A | 12/1998 | Roller | |
| 6,003,864 | A * | 12/1999 | Kuo et al. | 271/272 |
| 6,973,286 | B2 * | 12/2005 | Mandel et al. | 399/391 |
| 7,093,831 | B2 | 8/2006 | Biegelsen et al. | |
| 7,624,981 | B2 * | 12/2009 | Biegelsen et al. | 271/264 |
| 2004/0150156 | A1 * | 8/2004 | Fromherz et al. | 271/272 |
| 2004/0150158 | A1 * | 8/2004 | Biegelsen et al. | 271/303 |

* cited by examiner

*Primary Examiner* — Matthew G Marini

(57) ABSTRACT

A tightly integrated parallel printer includes a reconfigurable media path module that has a baffle that accepts sheets from above at a 12 o'clock position when in a first configuration and accepts sheets from a 6 o'clock position when in a second configuration. The two configurations of the baffle are established to permit one common media entry transport to be mounted in either of two positions, each satisfying one of the desired configurations.

6 Claims, 5 Drawing Sheets

RECONFIGURABLE SHEET TRANSPORT MODULE

This invention relates in general to an image forming apparatus, and more particularly, to an image forming apparatus employing a transport module that can be configured in two ways for use in two different places in a parallel printing system.

Modularity in reproduction machines has been used previously. For example, a plural mode modular reproduction apparatus is disclosed in U.S. Pat. No. 5,850,581 for selective different sheet printing modes with a common shared base frame unit having integral module mounting guides. Xerographic, as well as, ink jet printing engine modules are accommodated. Xerographic print engines with interchangeable developer units having different color toners, interchangeable into the same machine locations are disclosed in U.S. Pat. No. 5,144,369. Also, modular paper drawers, fusers, document handlers, etc. For example, U.S. Pat. No. 4,873,554 wherein the copy sheet system is a removable module. In U.S. Pat. No. 7,093,831 plural or multiple stacked paper handling modules are shown with different input and output paths. The reuse of 'common modules' can reduce development, manufacturing and service costs. Sheet transport modules in tandem parallel printing engines often have a degree of similarity with the exception of sheet entry and/or exit paths from the sheet handling module to print engine module and minor variations in similar modules may frustrate commonality.

Hence, there is a need for a sheet transport module that will accommodate variations in sheet entry and/or exit paths across architectures that direct sheets to an image marking engine for imaging and thereby increase module production volume and lower manufacturing cost for modular commonality focused architectures.

Accordingly, an improved transport module is disclosed for use in a tightly integrated parallel printer which includes a single reconfigurable baffle that accepts sheets from above at a 12 o'clock position when in a first configuration and accepts sheets from a 6 o'clock position when the baffle is repositioned in a second configuration. The two orientations of the baffle are established to permit one common media entry transport to be mounted in either of two positions, each satisfying one of the desired configurations. Additionally, the improved transport module could be reconfigurable based on the exit path of sheets or both entry and exit sheet paths, if desired.

The disclosed architecture may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally is the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 4:
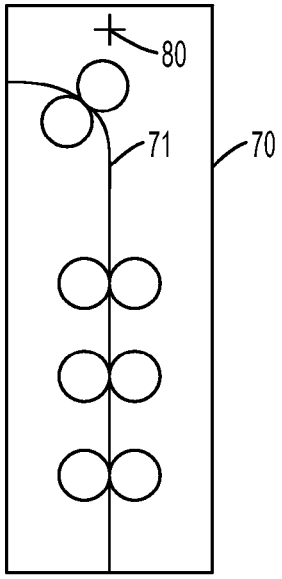
Figure 5:
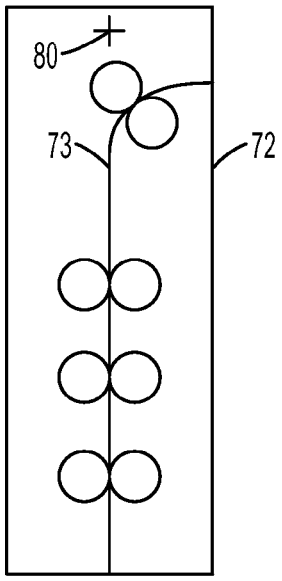
Figure 6:
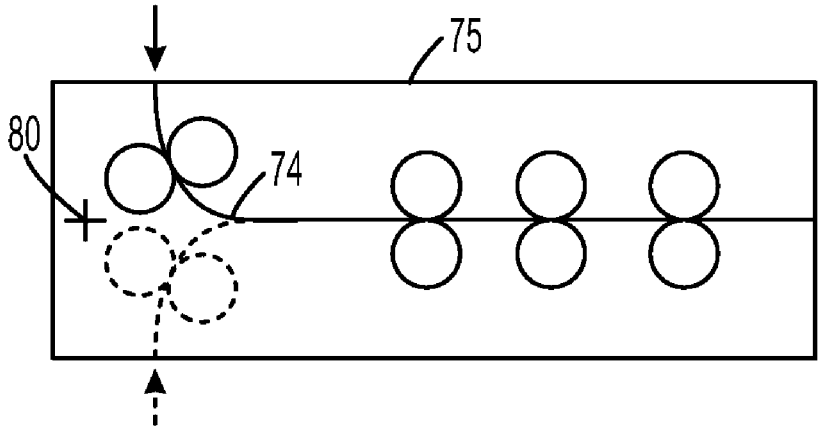
Figure 7:
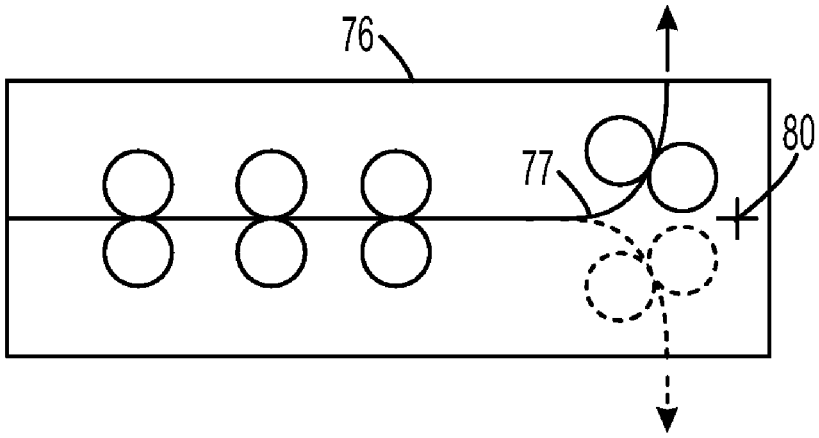
Figure 8:
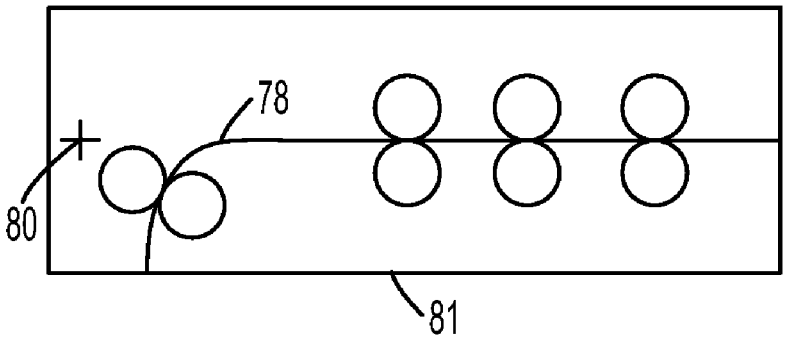
Figure 9:
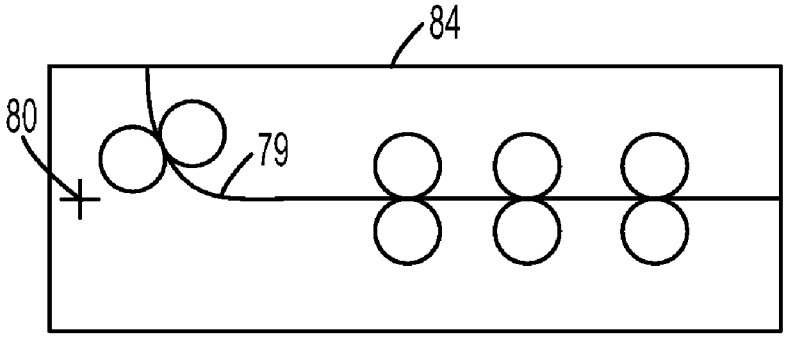

FIGS. 4 and 5 are enlarged side views of alternative transport modules that accept sheet entry from 9 o'clock and 3 o'clock positions;

FIGS. 6 and 7 are enlarged side views of horizontally positioned transport modules that with reconfigurable baffles that guide sheet into and out of the modules, respectively; and FIGS. 8 and 9 are enlarged side views of horizontally positioned transport modules that include angled reconfigurable baffles that guide sheet into and out of the modules, respectively.

Figure 1:
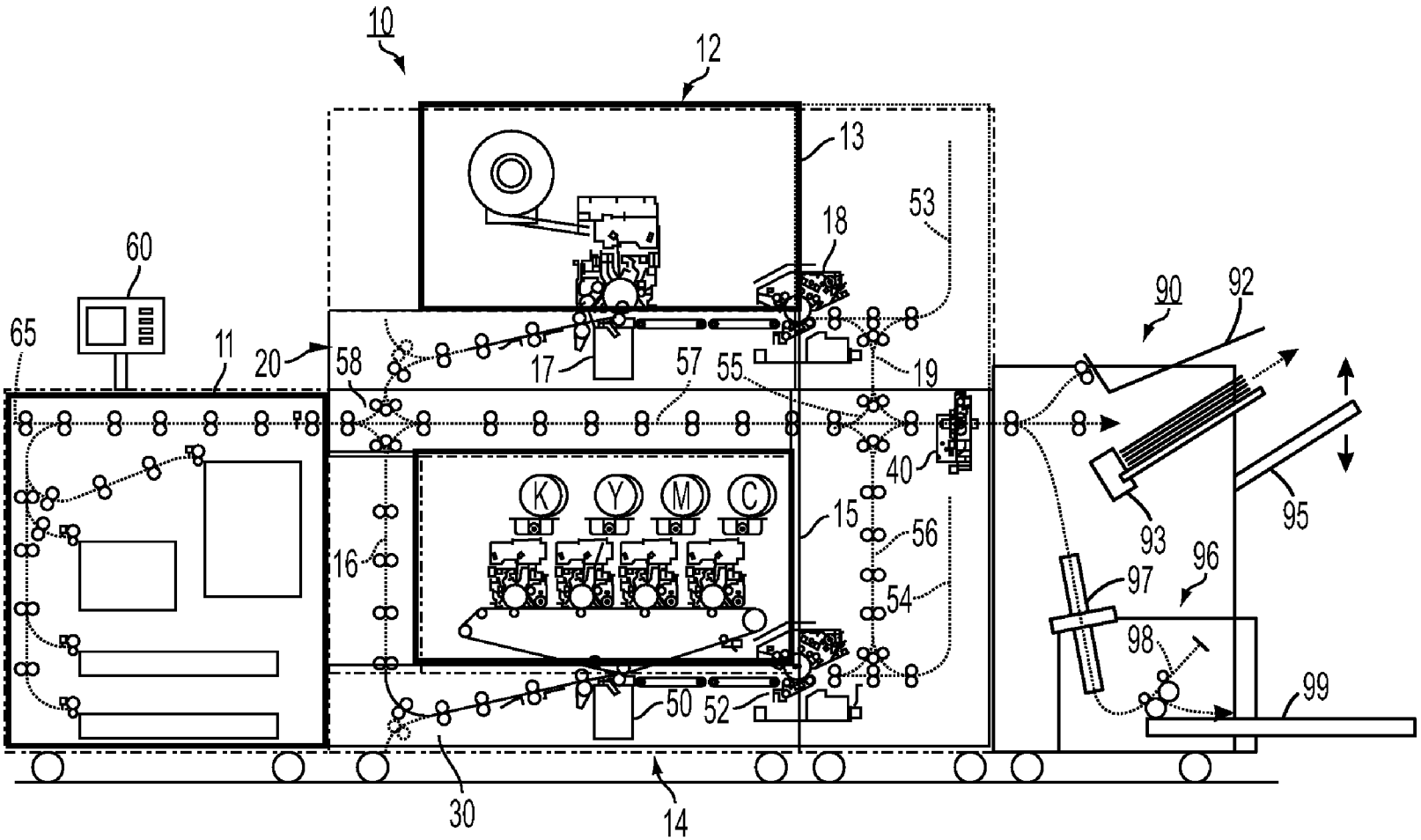
FIG. 1 is a frontal view of a tightly integrated parallel printer apparatus employing reconfigurable sheet transport modules.

FIG. 1 shows a schematic view of a printing system 10 comprising a sheet feed module 11, first and second electronic printers 12 and 14 that include a conventional monochrome marking engine module 13 and a conventional color image marking engine module (IME) 15, respectively, and a paper transport path leading into and out of each printer that includes media path modules 20 and 30 connecting these three modules and associated for tightly integrated parallel printing of documents with the system. Finished output from the printing system is sent to a conventional finisher F. For simplex monochrome copies, feeder module 11 includes a plurality of conventional sheet feeders that feed sheets into a media path highway 57 and into a conventional diverter gate system 58 that conveys the sheets into upper media path module 20 and on to transfer station 17 to have images from IME 13 transferred thereto. The sheets are then transported through fuser 18 and into inverter 53 where the sheet is inverter for proper face down output collation exiting to the vertical path 19, through a diverter gate system 53, decurler 40 and into finisher F. Alternatingly, virgin or unimaged sheets from sheet feed module 11 are fed downward through the diverter gate system 58 into vertical transport 16 and through lower media path module 30 to transfer station 50 to receive images from IME 15. The sheets are then transported through fuser 52, into inverter 54 for proper face down output collation, exiting into vertical transport 56, through diverter gate system 55 and through decurler 40 en route to conventional finisher 90 accepts unstapled sheets in upper catch tray 92 or stapled sheet at 93 in intermediate catch tray 95 or sheets stapled at 97 in booklet maker 96 and folded into booklets at folder 98 and outputted onto lower catch tray 99. Control station 60 allows an operator to selectively control the details of a desired job. Optionally, an insert or interposed sheet, such as, a cover, photo, tab sheet or other special sheet can be inserted into the first printer engine from an auxiliary sheet feed source (not shown) through sheet input 65, if desired.

For color image duplexing, sheets can be fed from feeder module 11 through diverter system 58, into color electronic printer 14 and downward along vertical transport 16 to lower media path module 30 and on to transfer station 50 to receive images on a first side thereof from IME 15 that includes cyan, magenta, yellow and black developer housings. Afterwards, the sheets are forwarded through fuser 52 and into inverter 54. The sheets leave inverter 54 trail edge first and are fed upwards along media transport path 56 and into media path highway 57, through diverter gate systems 55 and 58 and eventually downward along vertical transport 16 and back to lower media path module 30 and again through transfer station 50 to receive images onto a second side of the sheets. The sheets are then fused at fuser 52 and transported upward along media path 56, through diverter gate system 55 and out through decurler 40 and into finisher F. For monochrome image duplexing, sheets can be fed from feeder module 11 through diverter gate system 58, into monochrome electronic printer 12 and into the media path module 20 and on to transfer station 17 to receive monochrome images on a first side thereof from IME 13 that includes a black developer housing only. Afterwards, the sheets are forwarded through fuser 18 and into inverter 53. The sheets leave inverter 53 trail edge first and are fed downwards along media transport path 19, through diverter gate system 55 and into media path highway 57, through diverter gate system 58 and back to upper media path module 20 and again through transfer station 17 to receive monochrome images onto a second side of the sheets. The sheets are then fused at fuser 18 and transported downward along media path 19, through diverter gate system 55 and out through decurler 40 and into finisher F. Or alternatingly, combinations of one side monochrome and one side color imaged duplexed sheets can be produced by using these same media path elements in the appropriate sequences.

Figure 2:
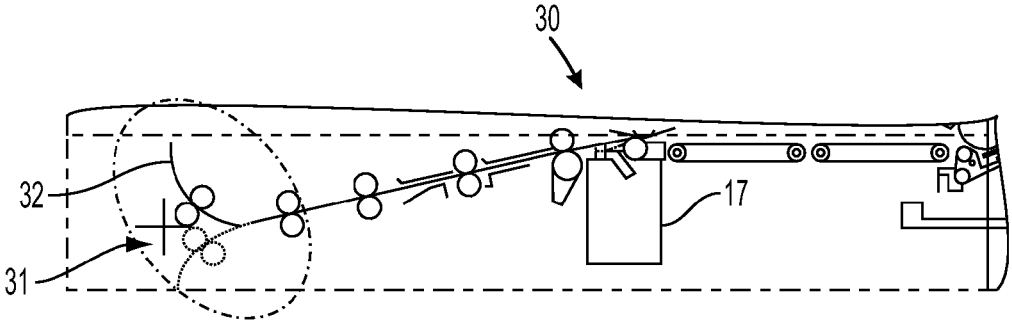
FIG. 2 is an enlarged side view of the lower media path module of FIG. 1 employing a reconfigurable baffle in a first orientation.
Figure 3:
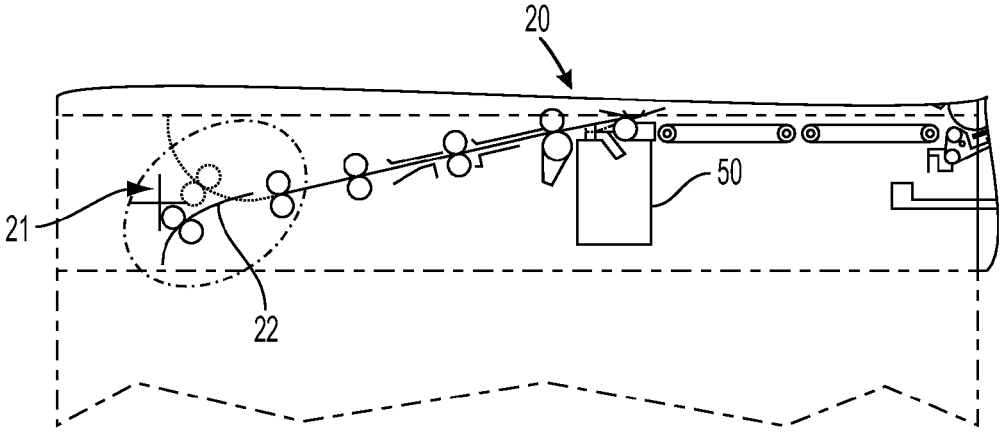
FIG. 3 is an enlarged side view of the upper media path module of FIG. 1 employing a reconfigurable baffle in a second orientation.

In FIG. 2, an enlarged side view of lower media path module 30 is shown in accordance with the present disclosure that includes a reconfigurable baffle 32 that has been rotated to a top sheet entry position about pivot point 31 in order to accept sheets from a 12 o'clock media entry position. In FIG. 3, an enlarged side view of upper media path module 20 is shown in accordance with the present disclosure that includes a reconfigurable baffle 22 that has been rotated to a bottom sheet entry position about pivot point 21 in order to accept sheets from a 6 o'clock media entry position. Rotation of baffle 22 or 32 can be accomplished at final integration by employing a screw, locking pin, detent or other similar commonly used mechanical fastening elements. Media path modules 20 and 30 of parallel, multi-engine reprographic printers 12 and 14 are identical except for media entry. The module proportions are established to permit one common media entry transport to be mounted in either of two positions, each satisfying one of the desired configurations of top or bottom sheet entry positions. Each media path module includes a media entry transport or curved baffle mechanism, registration transport, a transfer device and post transfer media transport.

Thus, a sheet transport module has been disclosed that can be configured in two ways for use in two places in a parallel printing system. In one configuration, sheets are accepted from above (12 o'clock) while the other accepts paper from below (6 o'clock). The sheet transport module can be mounted in either of two positions while allowing one common sheet entry point made possible by a curved media entry transport that is pivotally mounted and may be rotated and secured into either of two positions, discharging sheets into the same interface at a 3 o'clock position.

Alternatively or in addition, reconfigurable transports could be vertical modules with 9 o'clock and 3 o'clock sheet entry positions along baffles 71 and 73 that pivot about pivot point 80 as shown in FIGS. 4 and 5, respectively, or any other desired angle in between to direct sheets into the modules. As shown in FIG. 6, a horizontally positioned sheet transport module 75 includes a reconfigurable sheet entry baffle 74 that pivots about pivot point 80 to guide sheets into the transport module. Alternatively, in FIG. 7 transport module 76 includes reconfigurable sheet exit baffle 77 that is reconfigured about pivot point 80 to guide sheets out of transport module 76. Other alternative reconfigurable transport modules of the present disclosure include sheet transport modules 81 and 84 of FIGS. 8 and 9 that comprise angled reconfigurable baffles 78 and 79 which pivot about pivot point 80 in order to direct sheets into or out of sheet transport modules 81 and 84, respectively.

Another alternative embodiment comprises an additional print engine(s) located to the right of the color print engine. In this embodiment, all print engines can supply document sheets cooperatively to finisher F. Additionally, the first and second print engine can supply documents to each other for single pass duplex printing.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An improved reconfigurable sheet transport module containing multiple elements, comprising:

a media entry transport for guiding copy sheets in a predetermined direction into said reconfigurable sheet transport module;

a transfer device for transferring images from an image marking engine of a printer to said copy sheets;

a registration transport for conveying said copy sheets to and registering said copy sheets before they reach said transfer device;

a post transfer media transport for conveying said copy sheets downstream therefrom for further processing; and wherein said media entry transport includes a single curved baffle that is pivotable about a common pivot point between first and second positions, and wherein in said first position said curved baffle has a convex profile and in said second position has a concave profile with each profile providing a different sheet directional angle, and wherein said curved baffle is configured such that said copy sheets are conveyed against the same surface of said single curved baffle regardless of said first or second position.

2. The reconfigurable sheet transport module of claim 1, wherein said single curved baffle in said second position accepts sheets from a 6 o'clock entry position in said second stacked electronic printer.

3. The reprographic device reconfigurable sheet transport module of claim 1, wherein said single curved baffle in said first position directs printed sheets from an upper entry position.

4. The reconfigurable sheet transport module of claim 3, wherein said upper sheet entry position is located at about 12 o'clock.

5. The reconfigurable sheet transport module on claim 1, wherein said curved baffle includes a front sheet contacting curved surface and a rear non-sheet contacting curved surface configured in profile to complement said front sheet contacting curved surface.

6. The reconfigurable sheet transport module on claim 1, wherein said common pivot point is spaced from a rotation axis of said curved baffle.

* * * * *